US008651006B2

(12) United States Patent
Schmid et al.

(10) Patent No.: US 8,651,006 B2
(45) Date of Patent: Feb. 18, 2014

(54) APPARATUS AND METHOD FOR PRODUCING INDIVIDUAL BLANKS FROM A FILM WEB

(75) Inventors: Bernhard Schmid, Neubeuern (DE); Manuel Kollmuss, Riedering (DE)

(73) Assignee: Krones AG, Neutraubling (DE)

( * ) Notice: Subject to any disclaimer, the term of this patent is extended or adjusted under 35 U.S.C. 154(b) by 300 days.

(21) Appl. No.: 12/975,799

(22) Filed: Dec. 22, 2010

(65) Prior Publication Data

US 2011/0089212 A1 Apr. 21, 2011

Related U.S. Application Data

(63) Continuation of application No. PCT/EP2009/053682, filed on Mar. 27, 2009.

(30) Foreign Application Priority Data

Jun. 26, 2008 (DE) ..... 10 2008 030 489

(51) Int. Cl.
*B26D 3/08* (2006.01)

(52) U.S. Cl.
USPC ..... 83/879; 83/880; 83/884; 83/886

(58) Field of Classification Search
USPC ..... 225/2, 101, 4, 100; 83/879–887
See application file for complete search history.

(56) References Cited

U.S. PATENT DOCUMENTS

| | | | | |
|---|---|---|---|---|
| 1,771,983 | A * | 7/1930 | Wandel | 428/43 |
| 3,888,399 | A | 6/1975 | Hanson et al. | |
| 4,083,747 | A * | 4/1978 | Rochla | 156/510 |
| 4,177,730 | A * | 12/1979 | Schriber et al. | 101/248 |
| 4,577,789 | A | 3/1986 | Hofmann et al. | |
| 4,825,622 | A * | 5/1989 | Nigg | 53/203 |
| 4,929,226 | A | 5/1990 | Focke et al. | |
| 5,029,506 | A * | 7/1991 | Glendening | 83/660 |
| 5,255,008 | A * | 10/1993 | Yoshida | 346/24 |
| 5,296,071 | A * | 3/1994 | Tapp | 156/267 |
| 6,006,669 | A * | 12/1999 | Klein et al. | 101/485 |
| 6,523,595 | B1 * | 2/2003 | Milner et al. | 156/519 |
| 6,599,384 | B2 * | 7/2003 | Milner et al. | 156/252 |
| 6,729,216 | B2 * | 5/2004 | Schaede | 83/151 |
| 7,434,373 | B2 * | 10/2008 | Pommier | 53/435 |
| 2004/0211807 | A1 * | 10/2004 | Kolbe et al. | 225/100 |
| 2011/0169217 | A1 * | 7/2011 | Ziegler et al. | 271/278 |

FOREIGN PATENT DOCUMENTS

| | | | |
|---|---|---|---|
| DE | 1225102 | B | 9/1966 |
| DE | 2352166 | C2 | 12/1982 |
| DE | 4334094 | A1 | 4/1995 |
| DE | 10328868 | A1 | 1/2005 |

(Continued)

OTHER PUBLICATIONS

International Search Report mailed Jul. 9, 2009 from PCT/EP2009/053682 filed Mar. 27, 2009.

(Continued)

*Primary Examiner* — Omar Flores Sanchez
(74) *Attorney, Agent, or Firm* — Patentbar International, P.C.

(57) ABSTRACT

A device and a method for producing individual blanks from a foil web and their transport are disclosed. The foil web is fed with a first conveyor to a device for producing at least one potential parting line. The formed individual blanks are transferred with a second conveyor and fed for further processing. A tear in the individual blank is formed in the area of a guide system of the second conveyor.

8 Claims, 7 Drawing Sheets

(56) References Cited

FOREIGN PATENT DOCUMENTS

| | | | |
|---|---|---|---|
| DE | 202004011334 | U1 | 12/2005 |
| DE | 102005004496 | A1 | 2/2006 |
| DE | 10113524 | B4 | 6/2006 |
| EP | 0094647 | A | 11/1983 |
| EP | 0312877 | A | 4/1989 |
| GB | 2379918 | A | 3/2003 |
| WO | 2006007971 | A1 | 1/2006 |

OTHER PUBLICATIONS

German Search Report mailed Jan. 29, 2009 from DE 10 2008 030 489.1 filed Jun. 26, 2008.

International Preliminary Report of Patentability mailed Jan. 18, 2011 from PCT/EP2009/053682 filed Mar. 27, 2009.

* cited by examiner

APPARATUS AND METHOD FOR PRODUCING INDIVIDUAL BLANKS FROM A FILM WEB

RELATED APPLICATIONS

This Application is a Continuation application of International Application PCT/EP2009/053682 filed on Mar. 27, 2009, which in turn claims priority to German application DE 10 2008 030 489.1 filed on Jun. 26, 2008, both of which are incorporated herein by reference in their entirety.

FIELD OF THE INVENTION

The present invention relates to a device for producing individual blanks from a foil web Each individual blank is produced separately in the device and transferred via a corresponding conveyor. The individual blanks are preferably used as packaging and/or to form containers in the packaging industry.

The invention further relates to a method for producing parting lines in a foil web. In particular, the invention relates to a method for producing individual blanks from a foil web. Transport of the foil sheet is accomplished with a first conveyor, which feeds the foil web to the device. A second conveyor transfers the formed individual blanks from the device.

BACKGROUND OF THE INVENTION

German utility model DE 20 2004 011 334 U1 discloses a device for cutting the individual blanks from a foil sheet. Here, the individual blanks are produced in that the foil web is completely cut off with a knife at a defined location. A guide which extends tightly along the orbit of the knife receives the individual blank and guides it to a downstream conveyor.

The problem with the known prior art is that the individual blank must span an open space of between three and five centimeters between the cutter block and the conveyor. In this area the individual blank is frequently not received correctly by the conveyor and wraps itself around the cutter block or gets caught in another location in the device. A further disadvantage is the high rate of wear on the knife which is applied to the cutting block. The knife quickly becomes blunted and must be replaced frequently as a result.

SUMMARY OF THE INVENTION

The problem underlying the invention is to ensure failure-free feeding of foil blanks to a machine for further processing.

A further problem of the invention is to create a method which makes possible failure-free feeding of foil blanks to a machine for further processing.

Characteristics of advantageous developments result from the dependent claims in each case.

It is advantageous for the device for producing individual blanks from a foil web to be provided with a first conveyor for feeding the foil web and a second conveyor for handling the individual blanks. A device for producing at least one potential parting line is arranged in the first conveyor. A guide system for the foil web is arranged for the second conveyor. A control device is provided which controls the device such that an individual blank is separated from the foil web in the area of the guide system such that a tear is formed in the individual blank.

The guide system comprises a foil rack and a belt conveyor with applied negative pressure. A further advantageous embodiment is one in which the guide system comprises a foil rack and a band conveyor with applied negative pressure. The foil rack prevents the foil web or the individual blank from deviating upward. The belt conveyor with applied negative pressure also ensures transfer of the finished individual blank.

The first conveyor comprises a first pair of rollers and a second pair of rollers. Likewise, the first conveyor may comprise a first pair of rollers. The second conveyor comprises a third pair of rollers, a belt conveyor to which negative pressure is applied, and a foil rack. At least one pair of rollers is used to feed the foil web into the first conveyor. This first pair of rollers comprises two rollers between which the foil web is fed. The foil web is fed in the first conveyor toward the device for producing at least one potential parting line by rotating the rollers and by means of the pressure which the rollers exert on each other.

The device for producing at least one potential parting line may be implemented as a laser which produces a particular perforation pattern in the foil web. In the end, the individual blank is separated from the foil web at this potential parting line. According to a further embodiment of the invention, the device for producing at least one potential parting line may be a knife applied to a cutting block.

In the downstream second conveyor, at least one pair of rollers is used to transfer the foil web from the device for producing the at least one potential parting line to a downstream machine for further processing. A guide system is provided in the second conveyor to ensure that the foil web is safely transported.

A further possible development of the first conveyor is the use of an additional second pair of rollers. The device for producing the at least one potential parting line is then arranged between the first pair of rollers and the second pair of rollers.

The device additionally comprises a control device which decelerates a transport speed of the first conveyor in comparison to the second conveyor when the potential parting line of the foil web is in the area of the guide system. This enables tearing of the particular individual blank from the trailing foil web. It is particularly advantageous for the foil web to have already been fed through the guide system of the second conveyor prior to tearing of the individual blank.

A further possibility for producing the individual block is for the control device to accelerate the transport speed of the second conveyor in comparison to the first conveyor when the potential parting line of the foil web is in the guide system of the second conveyor.

It is furthermore advantageous if containers or articles are wrapped with an individual blank which was produced according to the device according to the invention.

The knife for producing the at least one potential parting line may be attached mounted to a punching device. In this embodiment of the invention, the knife is run vertically from above or below through the foil web and moved back to its starting position after producing the at least one parting line. The length of the individual blanks is regulated by the interval with which the knife is run downward or upward.

As a result of the perforation, the material of the foil web is processed such that it least one perforation hole and at least two perforation links are formed. The area ratio that arises as a result of the perforation is characterized in that the perforation in its area ratio has more perforation holes than perforation links. It is in addition sensible to make the perforation connectors very narrow so that a reliable tear may be formed in the individual blank from the foil web.

The method for producing individual blanks from a foil web is also advantageous. Transport occurs with a first conveyor for feeding the foil web and a second conveyor for transferring individual blanks formed from the foil web. At least one potential parting line is produced in the first conveyor with a device for producing at least one potential parting line. The foil web with the one parting line is fed continuously to the second conveyor. Depending on the position in the guide system, a control device regulates the transport speed of the first conveyor in relation to the transport speed of the second conveyor such that a tear is formed in the individual blank.

Individual blanks produced with the method according to the invention are used for packaging individual containers or the groups of containers.

BRIEF DESCRIPTION OF THE DRAWINGS

Based on the attached figures, the following explains in greater detail examples of the device according to the invention, the method according to the invention, and their advantages.

DETAILED DESCRIPTION OF THE PREFERRED EMBODIMENTS

The identical reference numbers will be used for the same or same acting elements of the invention. Furthermore, for the sake of clarity, reference numbers will be used only in the individual figures as they are necessary to describe the particular figure. The embodiments which are shown simply represent examples of how the device according to the invention or the method according to the invention may need implemented and do not represent any final limitation.

Figure 1:
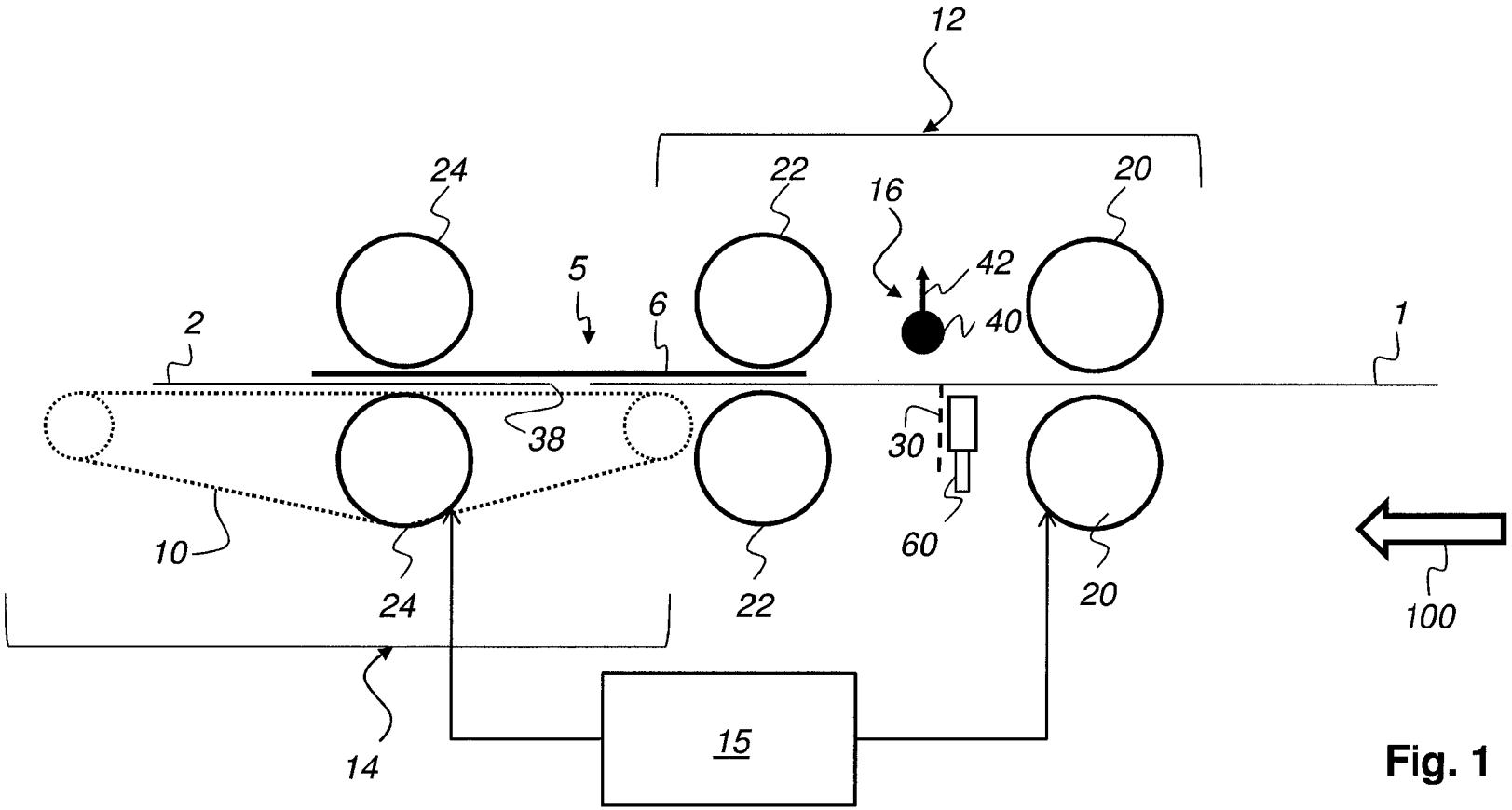
FIG. 1 shows schematically a device for producing individual blanks from a foil web.

FIG. 1 shows schematically the interaction of the first conveyor 12 with the device 16 for producing at least one potential parting line 30 and the second conveyor 14 which is downstream of the first conveyor. In the embodiment shown here, the first conveyor 12 has a device 16 for producing at least one potential parting line 30. Naturally, the first conveyor 12 enables the foil web 1 to be fed into the device 16 for producing at least one potential parting line 30. The first conveyor 12 comprises at least one first pair of rollers 20. In the embodiment shown here, the first conveyor 12 has a first and a second pair of rollers 20, 22. The device 16 for producing at least one potential parting line 30 may comprise a knife 42. The knife 42 is mounted to a cutting block by means of which a potential parting line 30 may be produced in the foil web 1. The foil web 1 is supported from below by the cutting edge 60 when the knife 42 is plunged such that the foil web 1 is supported against sagging.

The second conveyor 14 further comprises a guide system 5. The guide system 5 is provided with a foil rack 6 and a belt conveyor 10 with applied negative pressure. The guide system 5 prevents the foil web 1 from deviating upward. The transfer of the foil web 1 is accomplished by the second conveyor 14. In the embodiment of the invention shown here, the second conveyor 14 comprises at least a third pair of rollers 24 and the belt conveyor 10 already mentioned above.

Negative pressure may be applied to the belt conveyor 10 so that the separated individual blank 2 may be held for safe transfer. A special control device 15 for transport and/or rotational speed of the first and/or second conveyor 12, 14 separates the foil web 1 at the parting line 30 into individual blanks 2. Parting is accomplished by tearing the individual blank 2 from the foil web 1.

Figure 2:
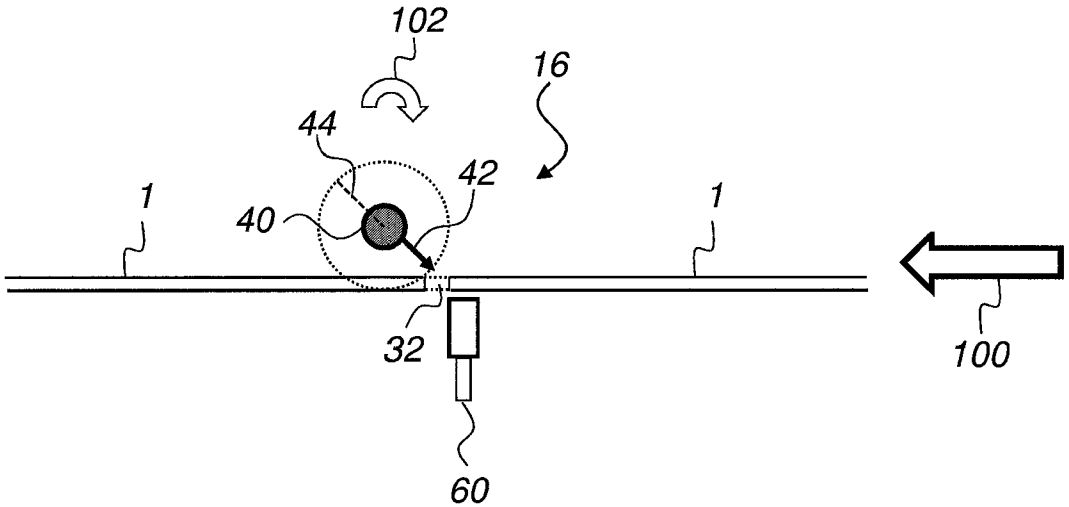
FIG. 2 shows a schematic representation of the production of a perforation by a rotating knife.
Figure 3:
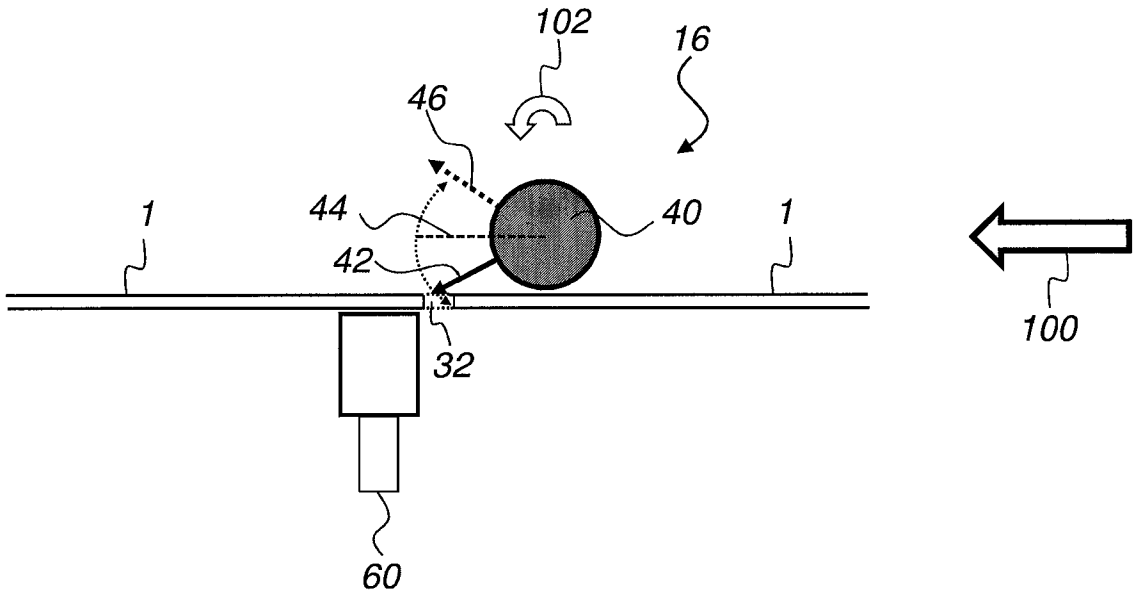
FIG. 3 shows a schematic representation of the production of the perforation by a knife, which executes an arc movement on a cutting block.

FIG. 2 shows a schematic representation of the production of the perforation 32 with the device 16 for producing at least one potential parting line 30. In the following description, the production of the at least one potential parting is limited to the use of a knife 42. This should not, however, be interpreted as a limitation of the invention. It is obvious to the person skilled in the art that the device 16 for producing the at least one potential parting line 30 may have several embodiments.

As shown in FIG. 2, the perforation 32 is produced by a knife 42 which is mounted to a cutting block 40. The cutting block 40 rotates in rotational direction 102 which is directed in the transport direction 100 of the foil web 1. This is advantageous because in this manner the knife 42 may be removed from the foil web 1 after production of the perforation 32 without the foil web 1 bunching up. In addition is the fact that the knife may also be moved by a curve controller in order to minimize unnecessary influence of the knife on the foil web 1. When producing the perforation 32, the knife 42 is passed along the cutting edge 60, which supports the foil web and so that it does not sag downward as a result of impingement by the knife 42.

Figure 4:
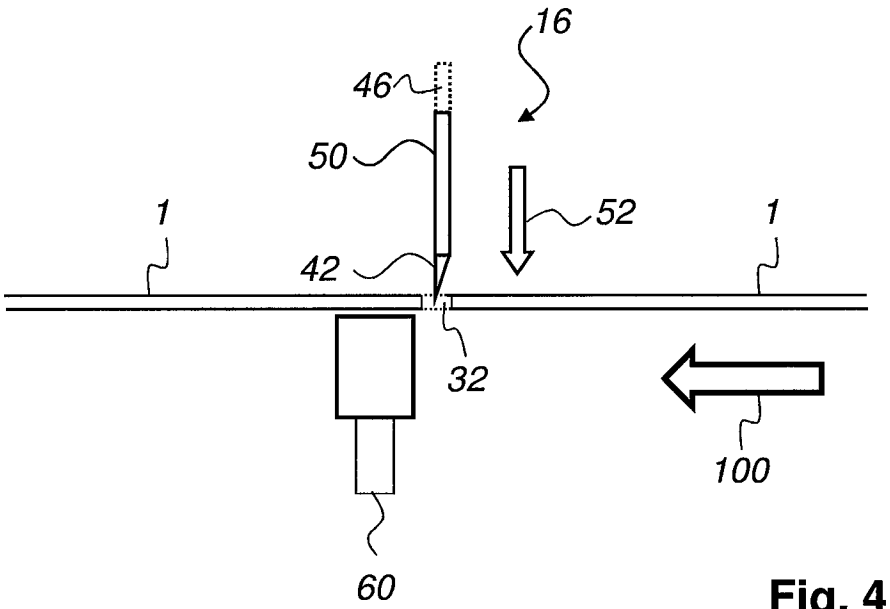
FIG. 4 shows a schematic representation of the production of the perforation by a knife which is mounted to a punching device.

FIG. 4 shows a schematic representation of a further embodiment of the production of the perforation 32 in the device 16 for producing at least a potential parting line 30. The perforation 32 is produced by a knife 42 which is mounted to a punching device 50. To produce the perforation 32, the punching device 50 is moved downward from its starting position 46 in the direction of the punch 52, thereby puncturing the foil web 1. While puncturing the foil web 1, the knife 42 is passed along the cutting edge 60 which supports the foil web 1 so that it does not sag downward as a result of impingement by the knife 42. When the knife 42 has punctured the foil web 1 to the desired depth, the punching device 50 is retracted to its starting position 46.

Figure 5:
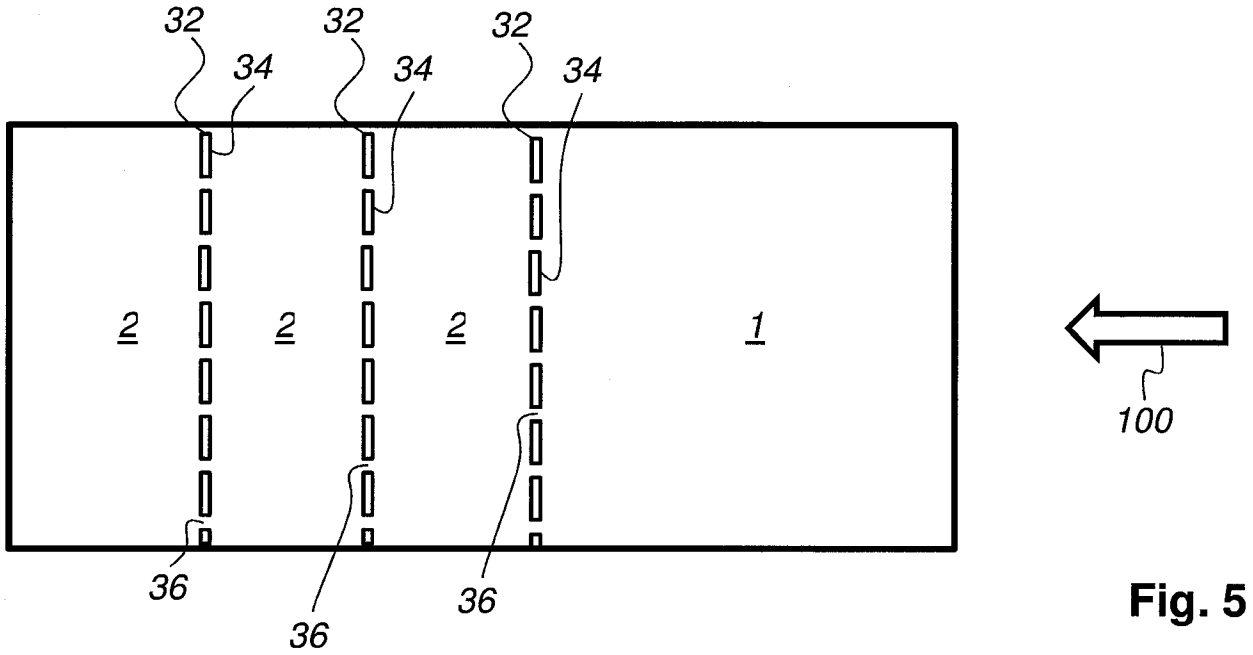
FIG. 5 shows a schematic of the perforation which was made in the foil web.

FIG. 5 shows schematically how several perforations 32 in the foil web 1 are arranged. The foil web 1 is fed in the direction of transport 100 of the device 16 for producing a parting line 30. As a result of one of the previously described embodiments, the perforation 32 is made in the foil web 1. Perforation holes 34 and perforation connectors 36 result in the creation of the perforation 32. The perforation connectors 36 are considerably narrower than the perforation holes 34, thereby enabling reliable parting of the foil web 1 into individual blanks 2.

Figure 6:
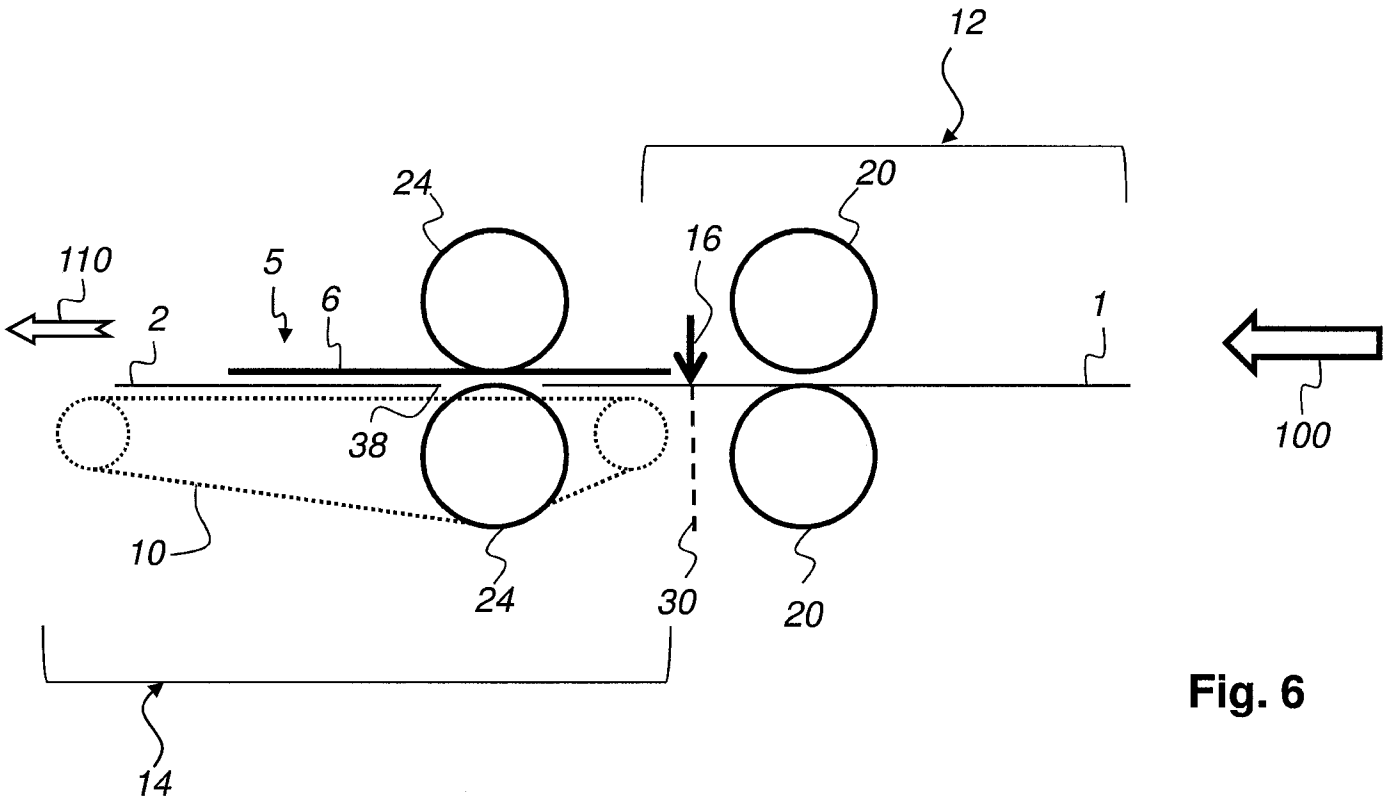
FIG. 6 shows schematically the parting of the foil web by decelerating the transport speed of the first conveyor.

FIG. 6 shows the parting of the foil web 1 into individual blanks 2. For reasons of clarity, the control device 15 is not shown in the following figures. In this embodiment of the invention, the transport speed produced by the first pair of rollers 20 is briefly decelerated. The transport speed of the second conveyor 14, which is in essence depicted by the third pair of rollers 24, continues to be operated at a constant and continuous transport speed. By decelerating the transport speed 106 of the first pair of rollers 20 (or of the first conveyor 12), tension 110 on the foil web 1 is increased such that it tears the potential parting line 30, forming the tear 38. As a result, the foil web 1 is separated into individual blanks 2.

Figure 7:
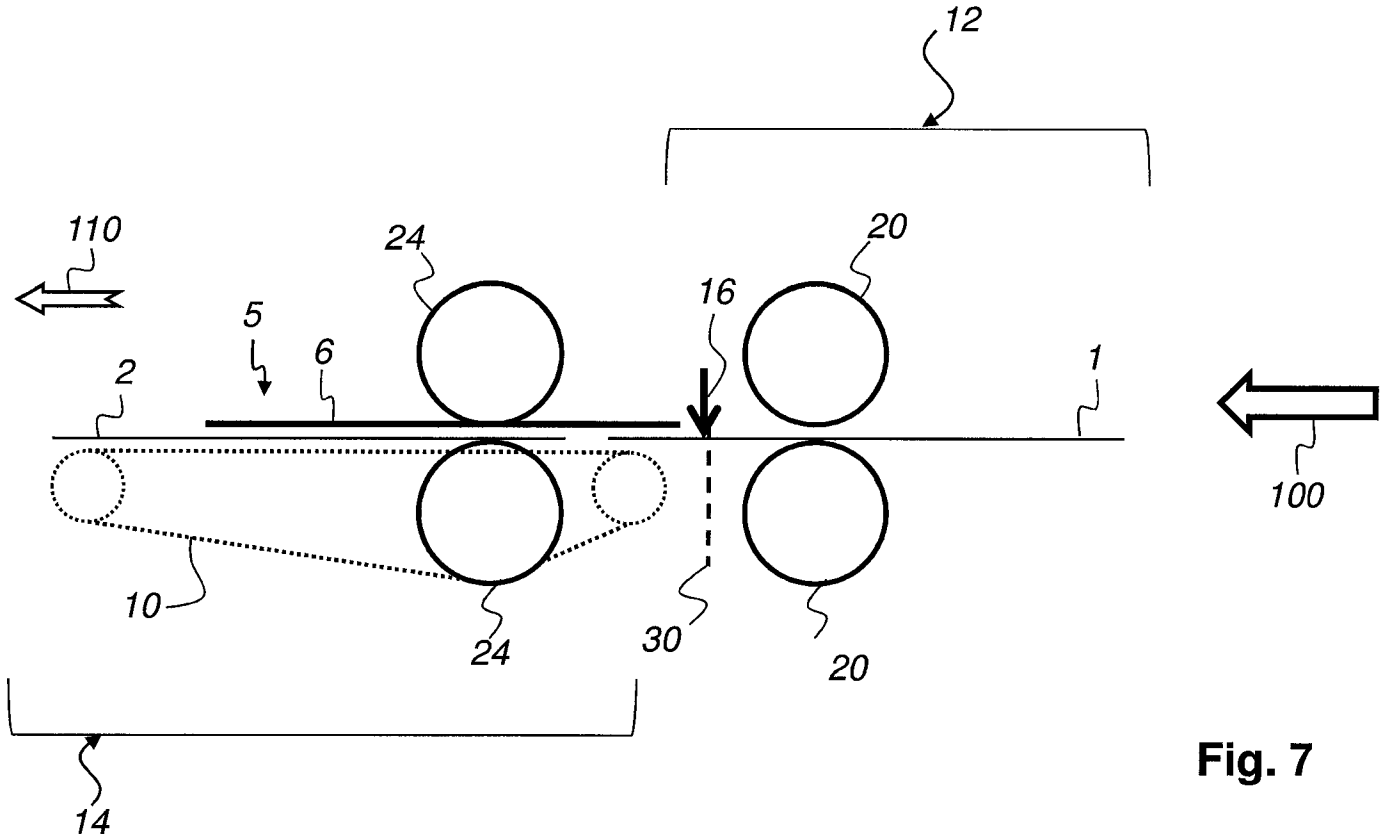
FIG. 7 shows schematically the parting of the foil web by accelerating the transport speed of the second conveyor.

FIG. 7 shows a further embodiment of the parting of the foil web 1 into individual blanks 2. In this embodiment, at least the transport speed of the second conveyor 14 is briefly accelerated so that the tension 110 acting on the foil web 1 via the third pair of rollers 24 is increased. At least the first pair of rollers 20 of the first conveyor 12 continues to be operated such that a constant and continuous transport speed is present. As a result of the briefly accelerated transport speed of the second conveyor 14, tension 110 on the foil web 1 increases such that it tears at the prescribed potential parting line 30 and is separated into individual blanks 2.

What is claimed is:

1. A method for producing individual blanks from a foil film comprising:

transporting the foil film by a first conveyor for feeding the foil film;

using a second conveyor for transferring the individual blanks formed from the foil film;

producing at least one parting line on the foil film in the first conveyor by a device producing the at least one parting line;

feeding the foil film with the at least one parting line continuously to the second conveyor; and controlling a transport speed of the first conveyor relative to a transport speed of the second conveyor by a control device to form a tear separating the individual blank when the parting line is a guide system of the second conveyor;

wherein the guide system and the second conveyor are arranged so that a tear in the foil film is guided and conveyed by the second conveyor; and wherein the guide system directly guides the tear separating the individual blank and the foil film behind the individual blank from the device producing the at least one parting line.

2. The method according to claim 1, wherein the guide system comprises a foil rack and/or a belt conveyor with applied negative pressure.

3. The method according to claim 1, wherein the foil film in the first conveyor is transported by a first pair of rollers.

4. The method according to claim 1, wherein the foil film in the first conveyor is transported by at least one first pair of rollers and a second pair of rollers.

5. The method according to claim 1, wherein the foil web and the individual blank in the second conveyor is transported by at least a third pair of rollers and a belt conveyor to which negative pressure is applied.

6. The method according to claim 1, wherein the transport speed of the first conveyor is decelerated in comparison to the transport speed of the second conveyor by the control device when the parting line on the foil film is in the guide system so that the tear separating the individual blank is formed inside the guide system.

7. The method according to claim 1, wherein the transport speed of the second conveyor in comparison to the transport speed of the first conveyor is accelerated by the control device when the parting line on the foil film is in the guide system so that the tear separating the individual blank is formed inside the guide system.

8. Use of the individual blank produced by the method according to claim 1 for packaging and/or formation of containers.

* * * * *